US010502037B2

(12) United States Patent
Archa et al.

(10) Patent No.: US 10,502,037 B2
(45) Date of Patent: Dec. 10, 2019

(54) TUBING AND ANNULAR GAS LIFT

(71) Applicant: Liberty Lift Solutions, LLC, Houston, TX (US)

(72) Inventors: William Garrett Archa, Decatur, TX (US); Corbin Mozisek, Richmond, TX (US)

(73) Assignee: Liberty Lift Solutions, LLC, Houston, TX (US)

( * ) Notice: Subject to any disclaimer, the term of this patent is extended or adjusted under 35 U.S.C. 154(b) by 0 days.

(21) Appl. No.: 15/916,256

(22) Filed: Mar. 8, 2018

(65) Prior Publication Data

US 2019/0277120 A1 Sep. 12, 2019

(51) Int. Cl.
*E21B 43/12* (2006.01)
*E21B 34/10* (2006.01)

(52) U.S. Cl.
CPC ..... *E21B 43/123* (2013.01); *E21B 34/10* (2013.01)

(58) Field of Classification Search
CPC ..... E21B 43/123
See application file for complete search history.

(56) References Cited

U.S. PATENT DOCUMENTS

2016/0145982 A1* 5/2016 Otta ..... E21B 43/123 137/155

FOREIGN PATENT DOCUMENTS

CA 1206090 6/1986

OTHER PUBLICATIONS

Blann, J.R. and Williams, J.D. 1984. Determining the Most Profitable Gas Injection Pressure for a Gas Lift Installation (includes associated papers 13539 and 13546 ). J Pet Technol 36 (8): 1305-1311. SPE-12202-PA. http://dx.doi.org/10.2118/12202-PA.

Vogel, J.V. 1968. Inflow Performance Relationships for Solution-Gas Drive Wells. J Pet Technol 20 (1): 83-92. SPE 1476-PA. http://dx.doi.org/10.2118/1476-PA.

Orkiszewski, J. 1967. Predicting Two-Phase Pressure Drops in Vertical Pipe. J Pet Technol 19 (6): 829-838. SPE-1546-PA. http://dx.doi.org/10.2118/1546-PA.

Hagedorn, A.R. and Brown, K.E. 1964. The Effect of Liquid Viscosity in Two-Phase Vertical Flow. J Pet Technol 16 (2): 203-210. SPE-733-PA. http://dx.doi.org/10.2118/733-PA.

Beggs, D.H. and Brill, J.P. 1973. A Study of Two-Phase Flow in Inclined Pipes. J Pet Technol 25 (5): 607-617. SPE-4007-PA. http://dx.doi.org/10.2118/4007-PA.

Hernandez, A. (2016): Fundamentals of Gas Lift Engineering, Well Design and Troubleshooting. ISBN 978-0-12-804133-8 Gulf Professional Publishing, Cambridge, MA, 966p.

(Continued)

*Primary Examiner* — Kristyn A Hall
(74) *Attorney, Agent, or Firm* — The Kubiak Law Firm

(57) ABSTRACT

A gas lift system may be installed within a well to allow gas lift operations where gas may be injected into the annular area of the well while producing fluids through the interior of the production tubular or upon demand may be reversed so that gas may be injected into the interior of the production tubular while producing fluids to the annular region of the well. In order to allow bidirectional production on demand two types of gas lift mandrels are installed as part of the production tubular. Both types of gas lift mandrels are configured such that gas lift valves are mounted to the exterior of the mandrels.

1 Claim, 3 Drawing Sheets

(56) References Cited

OTHER PUBLICATIONS

McMurry-Hughes Standard Mandrels; McMurry-Hughes Price List (Jun. 1, 1984).
Annular Gas Lift Well Design (2010).
Capsule for Annular Flow (2010).
Annular Gas Lift Well Design (2017).
Schlumberger, Gas Lift Design and Technology, 2000.
ANSI/API Specification 19G1, First Ed. Nov. 1, 2010. Side Pocket Mandrels.
Petroleum Technology Company AS, 2015, Gas-Lift Well Design.

* cited by examiner

TUBING AND ANNULAR GAS LIFT

BACKGROUND

Generally, when a well is drilled at least one hydrocarbon bearing formation is intersected. Part of the process of completing the well includes installing a liner within the well where the liner also intersects the hydrocarbon bearing formation. Once the liner is in place ports are opened up through the liner so that fluids, usually at least water and oil, may flow from the hydrocarbon bearing formation to the interior of the liner in a newly completed well, in many instances, there is sufficient pressure within the hydrocarbon bearing formation to force the fluid from the hydrocarbon bearing formation to the surface. After some period of time the pressure gradient drops to the point where the fluids from a hydrocarbon bearing formation are no longer able to reach the surface.

Once the fluids are no longer able to naturally reach the surface artificial lift may be employed. One form of artificial lift is known as gas lift. Gas lift involves, at various downhole points in the well, injecting gas into the central passageway of the production tubing string to lift the well fluid in the string. The injected gas, which is lighter than the well fluid displaces some amount of well fluid in the string. The displacement of the well fluid with the lighter gas reduces the hydrostatic pressure inside the production tubing string and allows the reservoir fluid to enter the wellbore at a higher flow rate.

In a conventional gas lift operation, a production tubular is assembled on the surface and includes a packer and a number of gas lift mandrels. Each mandrel has a check valve and a conventional injection pressure operated gas lift valve.

The production tubular is then run into the well so that the packer may be set at some point above the ports in the liner that provide access to the hydrocarbon bearing formation. Once the packer is set fluid may flow from a hydrocarbon bearing formation into an annular area between the liner and the production tubular. The packer prevents the fluid from flowing into the annular area above the packer however the fluid may flow to the bottom of the production tubular and into the production tubular. Once the fluid is in the production tubular it may flow upwards to a level dependent upon the hydrocarbon bearing formation pressure gradient. The fluid in the production tubular will generally flow up past the annular packer and will flow upwards past at least one of the side pocket mandrels. Each check valve in the side pocket mandrels prevents the fluid within the production tubular from flowing through the side pocket mandrel and into the annular area above the packer.

In order to begin producing the fluid to the surface, high-pressure gas such as nitrogen is injected into the annular area between the liner and the production tubular. The only outlet for the high-pressure gas is through the gas lift valves into the gas lift mandrels and then into the interior of the production tubular. As the high-pressure gas reaches the gas lift valve the high-pressure gas flows into the gas lift valve through ports in the side of the gas lift valve. The ports are located between the gas lift valve seat and the bellows. The high-pressure gas acts on the bellows adapter and the bellows compressing the bellows which in turn lifts the ball off of the seat. With the ball off of the seat the high-pressure, gas is able to flow through the seat into the check valve. The high-pressure gas then acts upon the check valve, where the check valve has a check dart that the high pressure gas compresses against a spring lifting the check dart off of a check pad allowing the high-pressure gas to flow through the check valve and into the gas lift mandrel. As the gas flows out of the gas lift mandrel and into the interior of the production tubular adjacent the gas lift mandrel the high-pressure gas causes the fluid to become a froth. The effect is similar to blowing bubbles into milk through a straw. The column of fluid which is now froth has a much lower density and therefore a lower head pressure than a pure liquid column. The natural formation pressure in conjunction with the flow of high pressure gas now flowing upward through the production tubular lifts the froth, and thus the hydrocarbons and other fluid, to the surface.

SUMMARY

Generally, an operator may utilize a gas lift system wherein high-pressure gas is injected into a well in the annular area between the casing and the production tubular. The gas then enters the production tubular at intervals along the production tubular in order to lift any liquid within the production tubular to the surface. However, in certain instances it has been found advantageous to be able to reverse the high-pressure gas injection and therefore the lift direction. The high-pressure gas is injected into the production tubular where the gas then flows through the production tubular and into the well where at predetermined points along the production tubular the high pressure gas is directed through a gas lift mandrel having a gas tight chamber and into the annular area between the production tubular and the casing.

More specifically a system has been envisioned where a production tubular is assembled on the surface. In order to facilitate production through the tubular to the surface a series of gas lift mandrels are installed as a part of the production string. The gas lift mandrels are spaced some preset distance apart from one another along the length of the production string. Each mandrel includes an externally mounted check valve and an externally mounted gas lift valve. The production tubular with the gas lift mandrels are then installed within the well. Each check valve prevents flow of any fluid or gas including the high-pressure injected gas, within the production tubular into the annular area between the production tubular and casing. The gas lift valve tends to prevent the flow of high pressure gas from the annular region into the production tubular until a particular preset pressure is reached. Upon reaching the preset pressure the system allows high-pressure gas to be injected into the production tubular.

In order to allow reverse flow, as may be required or desired by the operator, when that same system described above is assembled on the surface, an additional, different set of gas lift mandrels is installed as part of the same production string. The second set of gas lift mandrels has an external, gas tight chamber where a flow path through the external, otherwise gas tight chamber is through a check valve and a gas lift valve both installed within the external, gas tight chamber. The second set of gas lift mandrels allow high-pressure gas to be injected into the interior of the production tubular from the surface. As the high-pressure gas reaches the second set of mandrels the high-pressure gas flows through a port from the interior of the mandrel into the external, gas tight chamber. The high-pressure gas then surrounds the gas lift valve. The gas lift valve prevents the high-pressure gas from flowing from the external chamber into the annular area of the well between the production tubular and the casing until the pressure within the external chamber reaches up a particular preset pressure. Upon reaching the particular preset pressure the gas within the external chamber causes the gas lift valve to open allowing the high-pressure gas to flow from the external chamber through the check valve and into the annular region of the well between the production tubular and the casing. The check valve is typically placed between the gas lift valve and the annular region of the well preventing any fluid or gas, including high-pressure gas, in the annular region of the well from flowing into the gas lift valve, the external chamber, and the interior of the production tubular.

By having a first set of exterior mounted gas lift valves that allow gas to be injected from the annulus into the interior of the production tubular while also having a second set of exterior mounted gas lift valves that allow gas to be injected from the interior of the production tubular into the annular area between the production tubular and the casing or wellbore an operator can produce fluid in either direction as required by well conditions. The first set of exterior mounted valves include a check valve that prevent the flow of high pressure gas or fluid from the interior of the production tubular into the annular area. The second set of exterior mounted valves include an exterior gas tight chamber having a flow path that forces all flow through the gas lift valve and the check valve. In the second set of exterior mounted valves however the check valve prevents the flow of high pressure gas or fluid from the annular area into the interior of the production tubular.

Advantages and other features of the invention will become apparent from the following drawing, description and claims.

DETAILED DESCRIPTION

The description that follows includes exemplary apparatus, methods, techniques, or instruction sequences that embody techniques of the inventive subject matter. However, it is understood that the described embodiments may be practiced without these specific details.

Figure 1:
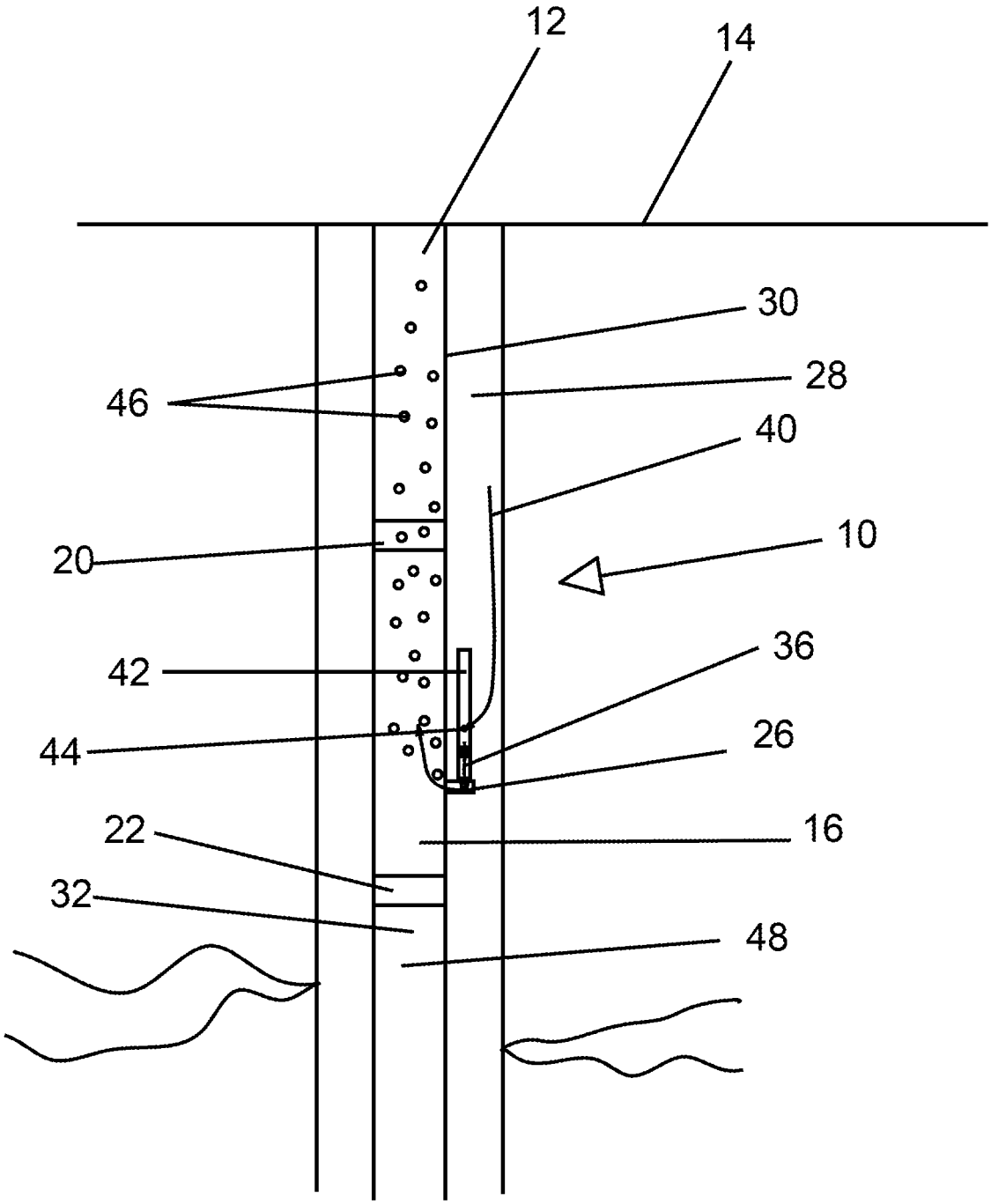
FIG. 1 depicts a gas lift system using high pressure gas injected into the annular area to assist in moving fluids in the interior of the tubular to the surface.

FIG. 1 depicts a gas lift system 10 where a production tubular 12 running from the surface 14 has a gas lift mandrel 16 assembled into the production tubular 12 using collars 20 and 22. The gas lift mandrel 16 includes a port 24 that provides access from the annular region 26, between the casing 28 and the exterior of the production tubular 30, to the interior of the production tubular 32. The check valve 36 is a one-way valve that is oriented to prevent oil or gas, including high-pressure gas, from flowing through this particular mandrel from the interior of the production tubular 32 to the exterior of the production tubular 30 while allowing the flow of fluid or gas from the annular region 26 to the interior of the production tubular 32.

In operation this particular configuration of the gas lift system 10 utilizes high-pressure gas as depicted by arrow 40 injected into the annular region 26 which then flows to gas lift valve 42 and into port 44 in gas lift valve 42 to enter the interior of gas lift valve 42. The gas then flows through gas lift valve 42 towards check valve 36. The high-pressure gas causes check valve 36 to open allowing the flow of high pressure gas from the annular region 26 to the interior of the production tubular 32. The high-pressure gas then enters the interior of the production tubular 32 forming areas of lower density 46. The areas of lower density 46 may be commonly referred to as bubbles. The bubbles 46 are utilized to reduce the density of the column of fluid 48 within the production tubular 12 so that the natural reservoir pressure may lift the column of fluid and bubbles to the surface.

Figure 2:
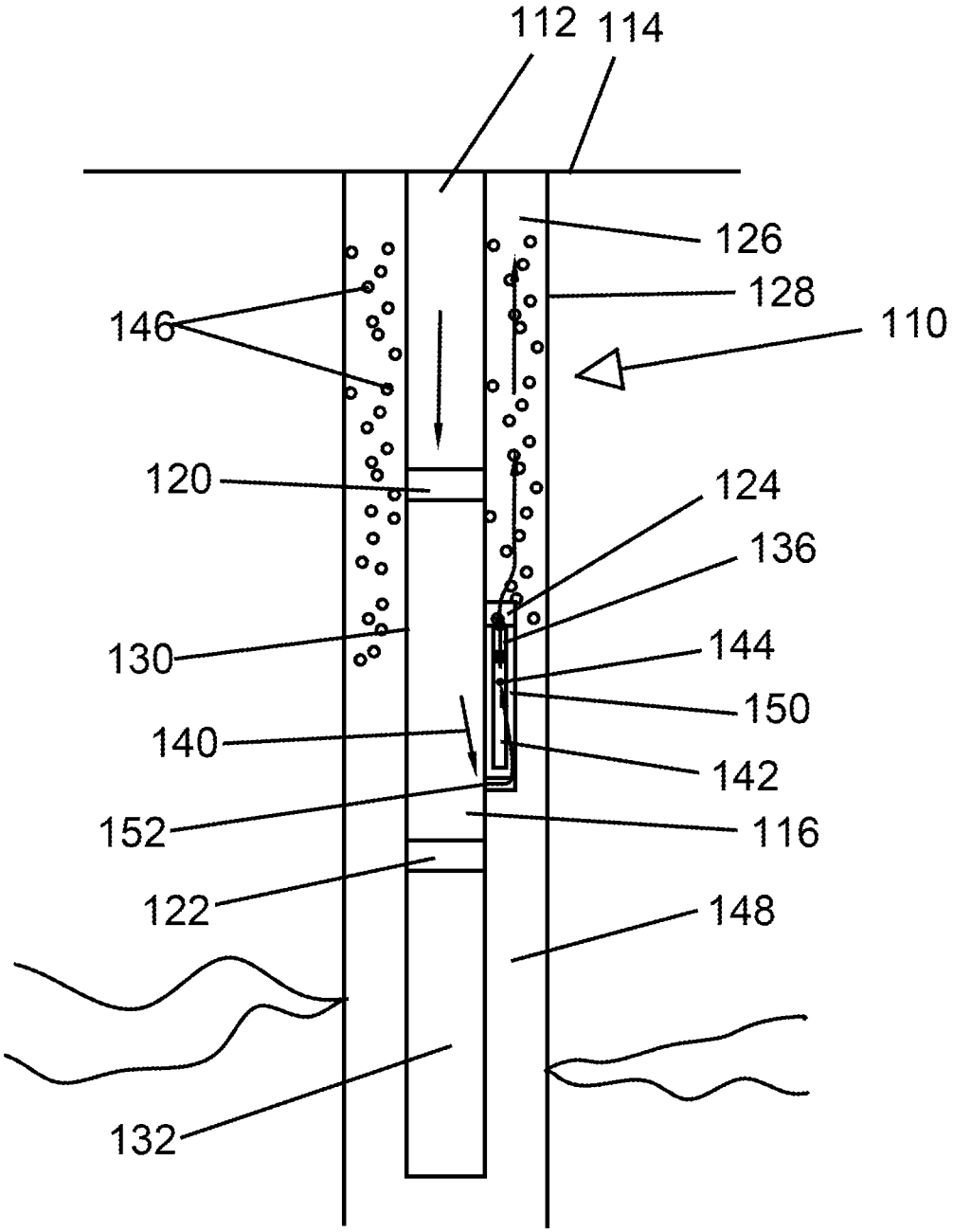
FIG. 2 depicts a gas lift system using high pressure gas injected into the interior of the production tubular to assist in moving fluids in the annular region to the surface.

FIG. 2 depicts a gas lift system 110 where a production tubular 112 running from the surface 114 has a gas lift mandrel 116 assembled into the production tubular 112 using collars 120 and 122. The gas lift mandrel 116 includes a gas tight external chamber 150. The gas tight external chamber 150 is attached to the gas lift mandrel 116 and provides a port 152 to allow gas inside the gas lift mandrel 116 to flow through the port 152 and into the interior of the gas tight external chamber 150. Gas in the external gas tight chamber 150 is then forced into gas lift valve 142 via port 144. The gas then continues on to check valve 136 where the gas causes the check valve 136 to open further allowing the gas access to port 124 which then provides access to the annular region 126, between the casing 128 and the exterior of the production tubular 130. The check valve 136 is a one-way valve that is oriented to prevent oil or gas, including high-pressure gas, from flowing from the annular region 126 and into the gas tight external chamber 150 thereby preventing oil or gas from flowing from the annular region 126 to the interior of the production tubular 132.

In operation this particular configuration of the gas lift system 110 utilizes high-pressure gas as depicted by arrow 140 injected into the interior of the production tubular 132. The high-pressure gas then flows into gas lift mandrel 116 and thereafter through port 152 and into the gas tight external chamber 150. The gas tight external chamber 150 forces the high-pressure gas to surround both the check valve 136 and the gas lift valve 142. The high-pressure gas then flows into the interior of the gas lift valve 142 through ports 144. The gas lift valve 142 further directs the high-pressure gas into the interior of check valve 136. The high-pressure gas causes check valve 136 to open allowing the flow of high pressure gas from the interior of the production tubular 132 to the annular region 126 while preventing oil or gas from flowing from the annular region 126 to the interior of the production tubular 132. As the high-pressure gas enters the annular region 126 areas of lower density or bubbles 146. The bubbles 146 are utilized to reduce the column of fluid 148 within the annular region 126 so that the natural reservoir pressure may lift the column of fluid 148 and bubbles 146 to the surface.

Figure 3:
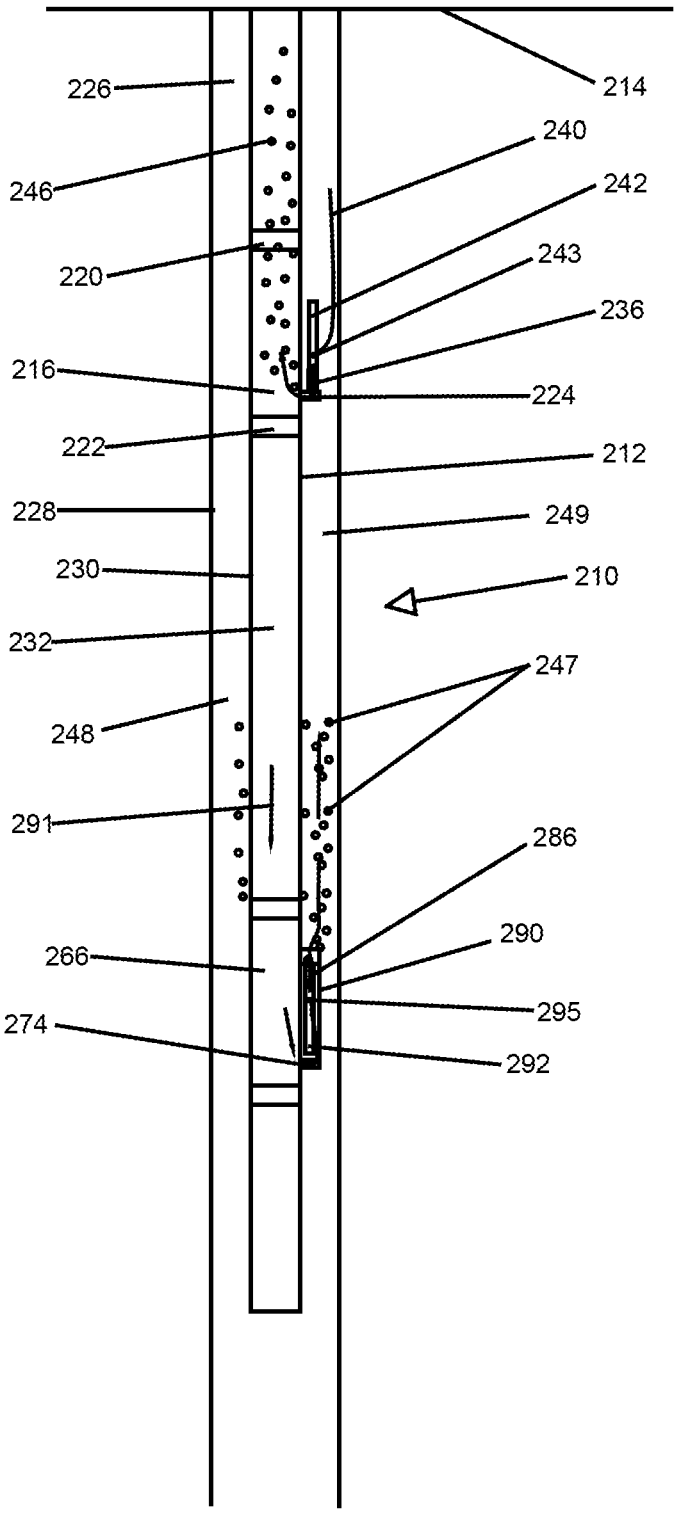
FIG. 3 depicts a gas lift system using both high pressure gas injected into the annular area to assist in moving fluids in the interior of the tubular to the surface and using high pressure gas injected into the interior of the production tubular to assist in moving fluids in the annular region to the surface.

FIG. 3 is an embodiment of the current invention where either the high-pressure gas may be injected into the production tubular to lift fluid through the annular region or, as desired, the high-pressure gas may be injected into the annular region allowing fluid within the production tubular to be lifted to the surface. The operator may switch between one direction or the other without pulling the production tubular or running a wireline system into the well to change out to gas lift valves.

The gas lift system in FIG. 3 includes a first mandrel 216 configured to allow a gas lift valve 242 and a check valve 236 to be attached providing for high-pressure gas to be injected from the annular region 226 into the interior of the production tubular 232. The gas lift system 210 also includes a second gas lift mandrel 266 provided with an external chamber 290 to allow a gas lift valve 292 and a check valve 286 to be attached that provide for high-pressure gas to be injected from the interior the production tubular 232 into the annular region 226 of the well which may be cased or open hole.

More specifically the gas lift system 210 includes a production tubular 212 running from the surface 214. The production tubular 212 has a first gas lift mandrel 216 assembled into the production tubular 212 using collars 220 and 222 and a second gas lift mandrel 266 also assembled into the production tubular 212. While only a first and a second gas lift mandrel are depicted is envisioned that numerous gas lift mandrels will be used within a single well. The first gas lift mandrels and second gas lift mandrels may be spaced consecutively or may be interspersed with one another.

The first gas lift mandrel 216 includes a port 224 that provides access from the annular region 226, between the casing 228 and the exterior of the production tubular 230, to the interior of the production tubular 232. The check valve 236 is attached to port 224 and is a one-way valve that is oriented at the first gas lift mandrel 216 to prevent oil or gas, including high-pressure gas, from flowing through the first gas lift mandrel 216 and port 224 from the interior of the production tubular 232 to the exterior of the production tubular 230 while allowing the flow of fluid or gas from the annular region 226 to the interior of the production tubular 232. A gas lift valve 242 is attached to check valve 236. Port 224, check valve 236, and gas lift valve 242 form a gas or fluid pathway between the interior of the production tubular 232 and annular region 226.

The second gas lift mandrel 266 includes a port 274 that provides access between the interior of the production tubular 232 through port 274 and a gas tight external chamber 290 such that the fluid and gas flow path between the interior of the gas lift mandrel 266 and the annular region 226, between the casing 228 and the exterior of the production tubular 230, goes through port 274, gas tight external chamber 290, into gas lift valve 292, check valve 286, through a second port in the gas tight external chamber 290, and then into the annular region 226. The check valve 286 is a one-way valve that is oriented at the second gas lift mandrel 266 to prevent oil or gas, including high-pressure gas, from flowing from the annular region 226 and into the gas tight external chamber 290 which also precludes the flow of fluids into the interior of the production tubular 232 via gas lift mandrel 266 while allowing the flow of fluid or gas from the interior of the production tubular 232 through the gas tight external chamber 290, gas lift valve 292, and check valve 286 to the annular region 226. Port 274, check valve 286, and gas lift valve 292 form a gas or fluid pathway between the annular region 226 and the interior of the production tubular 232.

In operation the operator may determine some point that gas lift is required to produce well fluid, which is typically a hydrocarbon water mix, through the interior of the production tubular 232 to the surface 214. In this instance high-pressure gas as depicted by arrow 240 is injected into the annular region 226. The high-pressure gas will generally have a flowpath to both the exterior of the first gas lift mandrel 216 and the exterior of the second gas lift mandrel 266. The high-pressure gas that reaches the second mandrel 266 has a flowpath through check valve 286, gas lift valve 292, the gas tight external chamber 290, and port 274. However, at the second mandrel 266 the check valve 286 is oriented to prevent the high-pressure gas or other fluids from flowing from the annular region 226 and into the flowpath that includes the gas tight external chamber 290. The high-pressure gas that reaches the first mandrel 216 has a flowpath into port 243 and into gas lift valve 242. Gas lift valve 242 then directs the high-pressure gas into check valve 236 which in this case is oriented to allow the high-pressure gas to flow through the check valve 236 and further through port 224 into the interior of the first gas lift mandrel 216 which is part of production tubular 232. As the high-pressure gas enters the interior of the production tubular 232 bubbles 246 are formed by the high-pressure gas within the fluid. The bubbles 246 reduce the density of the column of fluid 248 within interior of the production tubular 232 so that the natural reservoir pressure may lift the column of fluid 248 and the bubbles 246 to the surface.

In contrast the operator may determine some point that gas lift is required to produce well fluid through the annular region 226 to the surface 214. In this instance high-pressure gas as depicted by arrow 291 is injected into the interior of the production tubular 232. In this instance the high-pressure gas will generally have a flowpath to both the interior of the first gas lift mandrel 216 and the interior of the second gas lift mandrel 266. The high-pressure gas that reaches the first gas lift mandrel 216 has a flowpath through port 224, check valve 236, and gas lift valve 242. However, at the first gas lift mandrel 216 the check valve 236 is oriented to prevent the high-pressure gas or other fluids from flowing from the interior of the production tubular 232 and into the flowpath that includes the gas lift valve 242. The high-pressure gas that reaches the second gas lift mandrel 266 has a flowpath into port 274, gas tight external chamber 290, gas lift valve 292, and check valve 286. As the high-pressure gas flows from the interior of the production tubular 232 it flows through the port 274 and into the interior of the gas tight external chamber 290. The gas tight external chamber 290 then causes the high-pressure gas to flow through port 295 and into the interior of gas lift valve 292. Gas lift valve 292 then directs the high-pressure gas into check valve 286, provided that the high-pressure gas has sufficient pressure to open the gas lift valve. Check valve 236 is oriented to allow the high-pressure gas to flow through the check valve 236 and into the annular region 226. As the high-pressure gas enters the interior of the annular region 226 bubbles 247 are formed by the high-pressure gas within the fluid. The bubbles 247 reduce the density of the column of fluid 249 and within the annular region 226 so that the natural reservoir pressure may lift the column of fluid 248 and the bubbles 246 to the surface.

The methods and materials described as being used in a particular embodiment may be used in any other embodiment. While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A device for lifting fluid from a well comprising:

a production tubular having a first gas lift mandrel and a second gas lift mandrel; wherein the first gas lift mandrel does not include a chamber;

the first gas lift mandrel having a first check valve mounted on an exterior of the first gas lift mandrel oriented to allow gas or fluid to flow from the exterior of the first gas lift mandrel to an interior of the first gas lift mandrel;

the second gas lift mandrel having a chamber mounted on an exterior of the second gas lift mandrel and a second check valve within the chamber oriented to allow gas or fluid to flow from an interior of the second gas lift mandrel through the chamber and the second check valve to the annulus of the wellbore.

* * * * *